US006776898B1

(12) United States Patent
Wittenbrink et al.

(10) Patent No.: US 6,776,898 B1
(45) Date of Patent: Aug. 17, 2004

(54) PROCESS FOR SOFTENING FISCHER-TROPSCH WAX WITH MILD HYDROTREATING

(75) Inventors: Robert J. Wittenbrink, Kingwood, TX (US); Daniel Francis Ryan, Baton Rouge, LA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 09/542,894

(22) Filed: Apr. 4, 2000

(51) Int. Cl.[7] ..... C10G 45/00

(52) U.S. Cl. ..... 208/89; 208/58; 208/59; 208/97; 208/88; 208/72; 208/74; 518/726

(58) Field of Search ..... 208/87, 99, 58, 208/72, 71, 88, 95

(56) References Cited

U.S. PATENT DOCUMENTS

| | | | | |
|---|---|---|---|---|
| 4,568,663 A | | 2/1986 | Mauldin | 502/325 |
| 4,943,672 A | | 7/1990 | Hamner et al. | 585/737 |
| 5,032,249 A | | 7/1991 | Jones | 208/24 |
| 5,260,239 A | | 11/1993 | Hsia | 502/30 |
| 5,348,982 A | | 9/1994 | Herbolzheimer et al. | 518/700 |
| 5,750,819 A | | 5/1998 | Wittenbrink et al. | 585/734 |
| 5,904,834 A | | 5/1999 | Ansorge et al. | 208/24 |
| 5,911,874 A | * | 6/1999 | Cody et al. | 208/87 |
| 5,935,417 A | * | 8/1999 | Cody et al. | 208/87 |

FOREIGN PATENT DOCUMENTS

| | | | |
|---|---|---|---|
| EP | 0145042 | 6/1985 | C10G/45/60 |
| EP | 0435619 | 7/1991 | C10G/45/62 |
| EP | 579330 A1 | 1/1994 | C10G/2/00 |
| EP | 266898 B1 | 6/1994 | |

OTHER PUBLICATIONS

Ryland, Lloyd B., Tamele, M. W. and Wilson, J. N. Cracking Catalysts, Catalysis, vol. VII, Ed. Paul H, Emmet, Reinhold Publishing Corporation, New York, 1960, pp. 5–9.

* cited by examiner

*Primary Examiner*—Thuan D. Dang
(74) *Attorney, Agent, or Firm*—Mark D. Marin

(57) ABSTRACT

A novel process for forming hydrocarbon waxes from synthesis gas is disclosed. This invention teaches a process whereby a Fischer-Tropsch wax can be formulated such that the wax softness as defined by ASTM Standard Test Method for Needle Penetration of waxes (ASTM D-1321) can be adjusted to within a region most preferred for end use applications while simultaneously removing undesirable impurities, such as oxygenates (e.g., primary alcohols), olefins, and trace levels of aromatics. In a Fischer-Tropsch reactor, Fischer-Tropsch wax is formed from synthesis gas in a catalyzed reaction. The Fischer Tropsch wax is then subjected to a relatively mild hydroprocessing over a hydroisomerization catalyst under conditions such that essentially no boiling point conversion is obtained, but yet chemical conversions (e.g., hydrogenation and mild isomerization) occur yielding a high purity, hydrocarbon wax product of reduced hardness.

15 Claims, 1 Drawing Sheet

PROCESS FOR SOFTENING FISCHER-TROPSCH WAX WITH MILD HYDROTREATING

FIELD OF THE INVENTION

This invention relates to the production and processing of higher hydrocarbons, specifically waxes, useful as coating materials, in candles and in a wide variety of applications including food and drug applications which require high purity wax. More particularly, this invention relates to the production of high paraffin wax products produced by the reaction of carbon monoxide and hydrogen, the Fischer-Tropsch process. Still more particularly this invention relates to a catalytic process whereby raw Fischer Tropsch wax is subjected to a mild hydrotreating process yielding a high purity, hydrocarbon wax product of desired hardness without the need for further processing.

BACKGROUND OF THE INVENTION

The catalytic production of higher hydrocarbon materials from synthesis gas, i.e. carbon monoxide and hydrogen, commonly known as the Fischer-Tropsch process, has been in commercial use for many years. Such processes rely on specialized catalysts.

The original catalysts for Fischer-Tropsch synthesis were typically Group VIII metals, particularly cobalt and iron, which have been adopted in the process throughout the years to produce higher hydrocarbons. As the technology developed, these catalysts became more refined and were augmented by other metals that function to promote their activity as catalysts. Such promoter metals include the Group VIII metals, such as platinum, palladium, ruthenium, and iridium, other transition metals such as rhenium and hafnium as well as alkali metals. The choice of a particular metal or alloy for fabricating a catalyst to be utilized in Fischer-Tropsch synthesis will depend in large measure on the desired product or products.

The products from hydrocarbon synthesis must be useful in a variety of applications. The waxy product a hydrocarbon synthesis, particularly the product from a cobalt based catalyst process contains a high proportion of normal paraffins. It is generally known to catalytically convert the paraffin wax obtained from the Fischer-Tropsch process to lower boiling paraffinic hydrocarbons falling within the gasoline and middle distillate boiling ranges, primarily by hydrogen treatments e.g. hydrotreating, hydroisomerization and hydrocracking. However, new markets continue to expand in demand for petroleum and synthetic waxes. The varied and growing uses for the waxes, e.g. food containers, waxed paper, coating materials, electrical insulators, candles, crayons, markers, cosmetics, etc. have lifted this material from the by-product class to the product class in many applications.

Stringent requirements are set by regulatory authorities such as the FDA in the United States and the SCF in the European Union, which a wax should meet, particularly if the wax is to be used in food and drug applications. Further, it is a demanding task for the crude oil refiner to meet those requirements. Petroleum waxes derived from crude oil often have dark color, poor odor and numerous impurities requiring significant further refining, particularly when wax is to be used in food and drug applications which require highly refined wax in order to satisfy the regulatory authorities. The presence of sulfur, nitrogen and aromatic species, which induce a yellowish or brownish color, are undesirable in that they may present considerable health risks. Intensive wax refining techniques are required to improve thermal and light properties, ultra-violet stability, color, storage stability and oxidation resistance of the end products. Typically, such waxes are subjected to wax decolorization processes commonly denoted as wax finishing. Such methods are part of a time consuming and costly process and have a detrimental effect on opacity which is desirable in a number of applications where superior thermal and light properties, ultra-violet stability, color and storage stability are desired. These applications include, but are not limited to coating materials, crayons, markers, cosmetics, candles, electrical insulators and the like as well as food and drug applications.

Waxes prepared by the hydrogenation of carbon monoxide via the Fischer-Tropsch process have many desirable properties which make them superior to petroleum waxes in numerous respects. They have high paraffin contents and are essentially free of any sulfur, nitrogen and aromatic impurities found in petroleum waxes. However, untreated Fischer-Tropsch waxes may contain a small but significant quantity of olefins and oxygenates (e.g. long chain primary alcohols, acids and esters) which can cause corrosion in certain environments. Therefore, Fischer-Tropsch waxes typically undergo some type of hydroprocessing to obtain high purity.

In addition, Fischer-Tropsch waxes are harder than conventional petroleum waxes. The hardness of waxes and wax blends as measured by needle penetration can vary considerably. Hardness for waxes is generally measured by the needle penetration test ASTM D 1321. In general, the hardness of Fischer Tropsch waxes is an advantage since there exists a shortage of high-grade hard paraffin waxes. However, such hardness could limit the usefulness of untreated Fischer-Tropsch waxes in certain applications. Thus, it would be desirable to provide a process by which the hardness of these waxes could be efficiently adjusted to within desired ranges during hydroprocessing.

SUMMARY OF THE INVENTION

The present invention is directed to a mild hydrotreating process which removes the oxygenates and olefins and any aromatic species which may be present from a raw Fischer Tropsch wax while simultaneously reducing the hardness, thereby limiting or eliminating the need for further processing.

The process involves producing a raw Fischer-Tropsch wax in a hydrocarbon synthesis process and then passing the raw wax over a hydroisomerization catalyst under mild conditions such that chemical conversions (e.g., hydrogenation and mild isomerization) take place while less than 10% boiling point conversion (hydrocracking) occurs, thus preserving overall yield of wax product.

In one embodiment of the present invention, a raw Fischer-Tropsch wax is formulated via hydrocarbon synthesis and the wax hardness, as defined by ASTM Standard Test Method for Needle Penetration of waxes (ASTM D-1321), is adjusted to within a region preferred for end use applications, while simultaneously removing undesirable impurities, such as oxygenates (e.g., primary alcohols), olefins, and trace levels of aromatics if they are present.

DETAILED DESCRIPTION OF THE INVENTION

Figure 1:
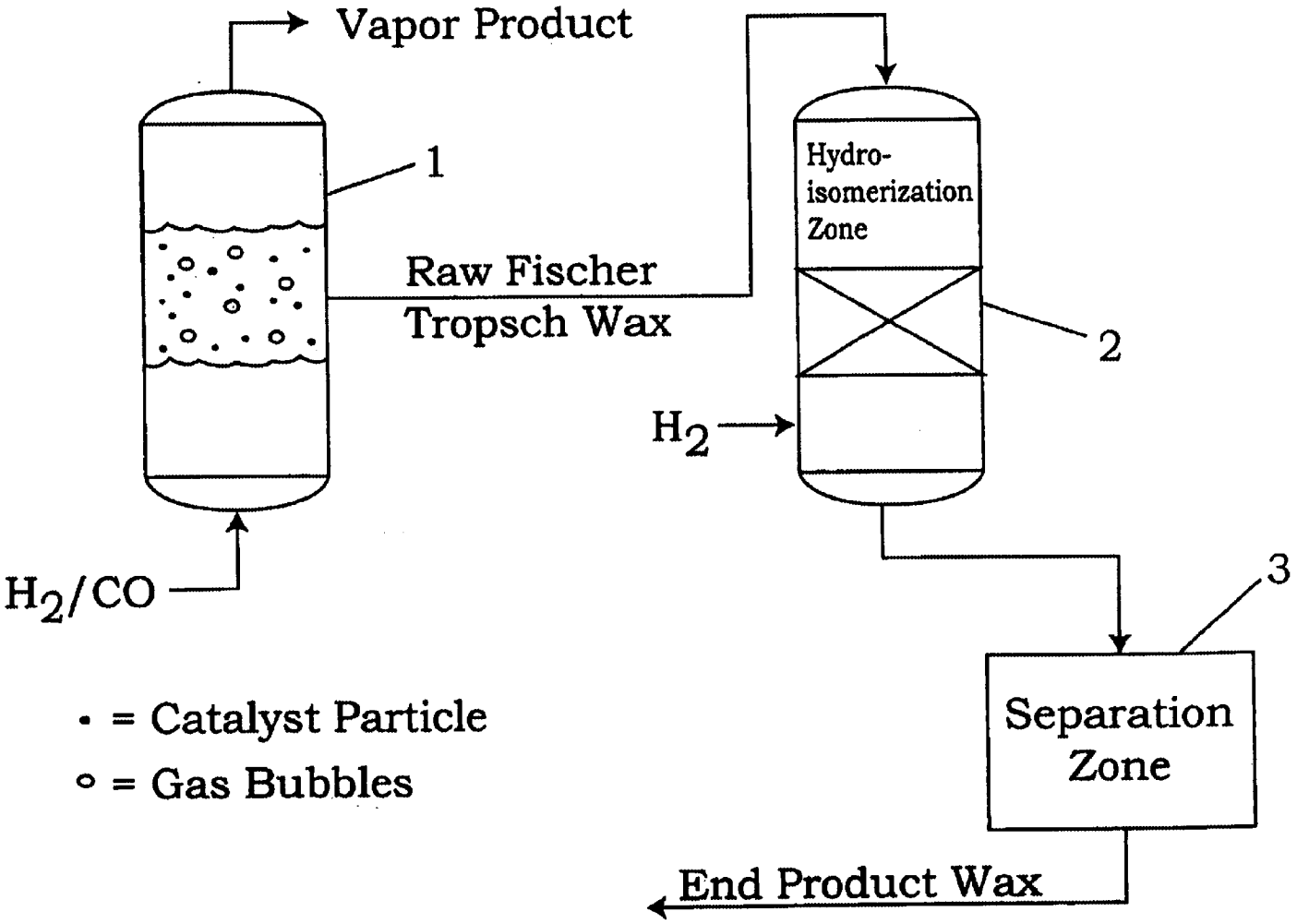
FIG. 1 shows a schematic of a process in accordance with the present invention.

The Fischer-Tropsch process can produce a wide variety of materials depending on catalyst and process conditions.

The waxy product of a hydrocarbon synthesis product, particularly the product from a cobalt based catalyst process, contains a high proportion of normal paraffins. Cobalt is a preferred Fischer-Tropsch catalytic metal in that it is desirable for the purposes of the present invention to start with a Fischer -Tropsch wax product with a high proportion of high molecular weight linear $C_{20}^{+}$ paraffins.

A preferred Fischer-Tropsch reactor to produce the raw wax of the present invention is the slurry bubble column reactor. This reactor is ideally suited for carrying out highly exothermic, three phase catalytic reactions. In such reactors (which may also include catalyst rejuvenation/recycling means as shown in U.S. Pat. No. 5,260,239) the solid phase catalyst is dispersed or held in suspension in a liquid phase by a gas phase which continually bubbles through the liquid phase, thereby creating a slurry. The catalysts utilized in such reactors can be either bulk catalysts or certain types of supported catalysts.

The catalyst in a slurry phase Fischer-Tropsch reaction useful in the present invention is preferably a cobalt, more preferably a cobalt -rhenium catalyst. The reaction is run at pressures and temperatures typical in the Fischer-Tropsch process i.e. temperatures ranging from about 190° C. to about 235° C., preferably from about 195° C. to about 225° C. The feed may be introduced, for example, at a linear velocity of at least about 12 cm/sec, preferably from about 12 cm/sec to about 23 cm/sec. A preferred process for operating a slurry phase Fischer-Tropsch reactor is described in U.S. Pat. No. 5,348,982.

A preferred Fischer -Tropsch Process is one that utilizes a non-shifting, (that is, no water gas shift capability) catalyst. Non-shifting Fischer-Tropsch reactions are well known to those skilled in the art and may be characterized by conditions that minimize the formation of $CO_2$ by products. Non shifting catalysts include, e.g. cobalt or ruthenium or mixtures thereof, preferably cobalt, and more preferably a supported, promoted cobalt, the promoter being zirconium or rhenium, preferably rhenium. Such catalysts are well known and a preferred catalyst is described in U.S. Pat. No. 4,568,663 as well as European Patent 0 266 898.

By virtue of the Fischer-Tropsch process, the recovered $C_{20}$+ waxy hydrocarbons in the 371° C.+ boiling range have nil sulfur and nitrogen. These hetero-atom compounds are poisons for the Fischer-Tropsch catalysts and are removed from the methane-containing natural gas that is conveniently used for preparing the synthesis gas feed for the Fischer-Tropsch process. Small amounts of olefins are produced in the Fischer-Tropsch process as well as well as some oxygenated compounds including alcohols and acids.

The raw wax product of the Fischer-Tropsh synthesis is subjected to a mild hydroisomerization process. The entire liquid effluent of the synthesis process may be withdrawn from the reactor and led directly to the hydroisomerization stage. In another embodiment, the unconverted hydrogen, carbon monoxide and water formed during the synthesis may be removed prior to the hydroisomerization step. If desired, the low molecular weight products of the synthesis stage, in particular, the $C_4$– fraction, for example, methane, ethane and propane may also be removed prior to the hydroisomerization treatment. The separation is conveniently effected using distillation techniques well known in the art. In another embodiment, a wax fraction typically boiling above 371° C. at atmospheric pressure is separated from the hydrocarbon product of the Fischer-Tropsch process and subjected to the hydroisomerization process of the invention.

Hydroisomerization is a well-known process and its conditions can vary widely. One factor to be kept in mind in hydroisomerization processes is that increasing conversion of feed hydrocarbons boiling above 371° C. to hydrocarbons boiling below 371° C. tends to increase cracking with resultant higher yields of gases and other distillates and lower yields of isomerized wax. In the present invention, cracking is maintained at a minimum, usually less than 10%, preferably less than 5%, more preferably less than 1% thus maximizing wax yield.

The hydroisomerization step is carried out over a hydroisomerization catalyst in the presence of hydrogen under conditions such that the 371° C.+ boiling point conversion to 371° C.– is less than about 10%, more preferably less than about 5%, most preferably less than about 1%. These conditions comprise relatively mild conditions including a temperature from about 204° C. to about 343° C., preferably from about 286° C. to about 321° C. and a hydrogen pressure of about 300 to about 1500 psig, preferably about 500 to about 1000 psig, more preferably about 700 to about 900 psig to reduce oxygenate and trace olefin levels in the Fischer-Tropsch wax and to partially isomerize the wax.

Typical broad and preferred conditions for the hydroisomerization step of the present invention are summarized in the table below:

| Condition | Broad Range | Narrow Range |
|---|---|---|
| Temperature, ° C. | 204–343 | 286–321 |
| Total Pressure, psig | 300–1500 | 500–1000 |
| Hydrogen Treat Rate, SCF/B | 500–5000 | 2000–4000 |

The resulting hydrotreated/hydroisomerized Fischer-Tropsch wax may then be fractionated to obtain a wax fraction having a desired melting point (or boiling point) and needle penetration value.

While virtually any catalyst useful in hydroisomerization may be satisfactory for the mild hydrotreating/hydroisomerization step, some catalysts perform better than others and are preferred. For example, catalysts containing a supported Group VIII noble metal, e.g., platinum or palladium, are useful as are catalysts containing one or more Group VIII base metals, e.g., nickel or cobalt, in amounts of about 0.5–20 wt % which may or may not also include a Group VI metal, e.g. molybdenum in amounts of about 1–20 wt %. The support for the metals can be any refractory oxide or zeolite or mixtures thereof. Preferred supports include silica, alumina, silica-alumina, silica-alumina phosphates, titania, zirconia, vanadia, and other Group III, IV, VA or VI oxides, as well as Y sieves, such as ultrastable Y sieves. Preferred supports include alumina and silica-alumina where silica concentration of the bulk support is less than about 50 wt %, preferably less than about 35 wt %. More preferred supports include amorphous silica-alumina co-gel where the silica is present in amounts of less than about 20 wt %, preferably 10–20 wt %. Also the support may contain small amounts, e.g., 20–30 wt %, of a binder, e.g., alumina, silica, Group IV A metal oxides, and various types of clays, magnesia, etc., preferably alumina.

Preferred catalysts of the present invention include those comprising a non-noble Group VIII metal, for example, cobalt, in conjunction with a Group VI metal, for example, molybdenum, supported on an acidic support. A preferred catalyst has a surface area in the range of about 1 80–400

$m^2$/gm, preferably 230–350 $m^2$/gm, and a pore volume of 0.3 to 1.0 ml/gm, preferably 0.35 to 0.75 ml/gm, a bulk density of about 0.5–1.0 g/ml, and a side crushing strength of about 0.8 to 3.5 kg/mm.

A preferred catalyst is prepared by co-impregnating the metals from solutions onto the supports, drying at 100–150° C., and calcining in air at 200–550° C. The preparation of amorphous silica-alumina microspheres for supports is described in Ryland, Lloyd B., Tamele, M. W., and Wilson, J. N., Cracking Catalysts, Catalysis: volume VII, Ed. Paul H. Emmett, Reinhold Publishing Corporation, New York, 1960, pp. 5–9.

In a preferred catalyst, the Group VIII metal is present in amounts of about 5 wt % or less, preferably 2–3 wt %, while the Group VI metal is usually present in greater amounts, e.g., 10–20 wt %. A typical catalyst is shown below:

| | |
|---|---|
| Co wt % | 2.5–3.5 |
| Mo wt % | 15–20 |
| $Al_2O_3$–$SiO_2$ | 60–70 |
| $Al_2O_3$-binder | 20–25 |
| Surface Area | 290–355 $m^2$/gm |
| Pore Volume (Hg) | 0.35–0.45 ml/gm |
| Bulk Density | 0.58–0.68 g/ml |

Referring to FIG. 1, synthesis gas (hydrogen and carbon monoxide in an appropriate ratio) is fed to Fischer-Tropsch reactor 1, preferably a slurry reactor and contacted therein with an appropriate Fischer-Tropsch catalyst. Raw Fischer-Tropsch (F/T) wax product is recovered directly from reactor 1. This raw Fischer-Tropsch wax is introduced into a hydroisomerization process unit 2 along with hydrogen and contacted therein with a hydroisomerization catalyst under mild hydroisomerization conditions. The hydroisomerized Fischer-Tropsch (F/T) wax from the hydroisomerization zone of hydroisomerization unit 2 may be fractionated under vacuum in separation zone 3 into end product wax fractions with different melting points if desired.

The following Examples will serve to illustrate but not to limit this invention.

EXAMPLE 1

Preparation of Fischer-Tropsch Wax

A mixture of hydrogen and carbon monoxide synthesis gas ($H_2$/CO=2.0–2.2) was converted to heavy paraffins in a slurry bubble column Fischer-Tropsch reactor. The catalyst utilized was a titania supported cobalt rhenium catalyst previously described in U.S. Pat. No. 4,568,663. The reaction was conducted at about 204–232° C., about 280 psig, and the feed was introduced at a linear velocity of 12 to 17.5 cm/sec. The kinetic alpha of the Fischer-Tropsch product was between 0.90 and 0.96. The Fischer-Tropsch wax feed was withdrawn directly from the slurry reactor.

EXAMPLE 2

Hydrotreatment/hydroisomerization Fischer-Tropsch Raw Wax

The Fischer-Tropsch wax prepared in Example 1 was treated over the cobalt/molybdenum on silica-alumina catalyst described herein in at several conditions. The hydrotreated/hydroisomerized Fischer-Tropsch wax was then fractionated under vacuum. The conditions for each of these runs, labeled Levels A through E, as well as the 371° C.+ conversion and product yields compared to untreated raw Fischer Tropsch wax are given in Table 1.

TABLE 1

Conditions and Yields of Hydrotreated/Hydroisomerized of Fischer-Tropsch Wax

| Hydrotreatment Severity | Raw Wax | Level A | Level B | Level C | Level D | Level E |
|---|---|---|---|---|---|---|
| LHSV | | 1.170 | 1.313 | 1.210 | 1.307 | 1.238 |
| Temperature, ° C. | | 286.8 | 320.2 | 326.9 | 333.6 | 340.8 |
| P (outlet), Psig | | 724.5 | 724.8 | 724.9 | 725.0 | 725.0 |
| $H_2$ Treat, SCF/B | | 2335 | 2080 | 2260 | 2090 | 2205 |
| Yield, wt. % | | | | | | |
| C1 | | trace | trace | trace | 0.002 | 0.002 |
| C2 | | trace | 0.002 | 0.003 | 0.006 | 0.011 |
| C3 | | 0.001 | 0.005 | 0.025 | 0.033 | 0.092 |
| i-C4 | | 0.003 | 0.011 | 0.049 | 0.051 | 0.153 |
| n-C4 | | 0.002 | 0.008 | 0.024 | 0.030 | 0.087 |
| C5 + gas | | 1.716 | 1.298 | 4.229 | 2.925 | 7.357 |
| TLP ibp–343° C. | 23.41 | 21.339 | 21.901 | 22.770 | 25.285 | 23.177 |
| 343–382° C. | 12.46 | 13.956 | 9.092 | 11.337 | 12.420 | 11.805 |
| 382–421° C. | 11.77 | 10.872 | 14.398 | 13.001 | 8.416 | 13.180 |
| 421–460° C. | 9.52 | 9.623 | 7.757 | 9.270 | 9.841 | 7.670 |
| 460–499° C. | 11.29 | 7.140 | 10.612 | 4.659 | 5.652 | 5.436 |
| 499–552° C. | 8.75 | 12.492 | 12.353 | 12.973 | 13.486 | 12.137 |
| 552° C.+ | 22.80 | 22.856 | 22.563 | 21.660 | 21.853 | 18.893 |
| | 100.00 | 100.000 | 100.000 | 100.000 | 100.000 | 100.000 |
| 371° + CONV. (%) | 0 | 0 | 1.3 | 4.2 | 5.3 | 14.5 |

EXAMPLE 3

Melting Points and Needle Penetration Values of Hydrotreated/Hydroisomerized Fischer-Tropsch Wax The melting point (mp °C.) and needle penetration value, as defined by ASTM Standard Test Method for Needle Penetration of Waxes (ASTM D-1321), was then determined for each fraction. The needle penetration of the wax is the depth, in tenths of a millimeter (dmm), to which a standard needle penetrates into the wax under defined conditions. Penetration is measured with a penetrometer, which applies a standard needle to the sample for 5 seconds under a load of 100 grams. The results are shown in Table 2.

TABLE 2

| | Raw wax | | Level A H/T | | Level B H/T | | Level C H/T | | Level D H/T | | Level E H/T | |
|---|---|---|---|---|---|---|---|---|---|---|---|---|
| Boiling Range | Pen, (dmm) | mp, ° C. | Pen, (dmm) | mp, ° C. | Pen, (dmm) | mp, ° C. | Pen, (dmm) | mp, ° C. | Pen, (dmm) | mp, ° C. | Pen, (dmm) | mp, ° C. |
| ibp–343° C. | | liq. | | | | liq. | | | | liq. | | |
| 343–382° C. | | 35.8 | | | | liq. | | | | 35.9 | | |
| 382–421° C. | 252.5 | 47.4 | 325.0 | 48.3 | 320.0 | 44.6 | 318.0 | 43.2 | 310.0 | 46.1 | 325.0 | 43.4 |
| 421–460° C. | 86.5 | 57.9 | 76.8 | 58.1 | 142.8 | 55.1 | 71.0 | 57.3 | 127.0 | 54.4 | 98.5 | 54.O |
| 460–499° C. | 28.3 | 67.1 | 30.3 | 65.2 | 42.5 | 62.6 | 46.8 | 64.2 | 51.5 | 62.1 | 92.5 | 60.8 |
| 499–552° C. | 16.3 | 75.6 | 22.0 | 74.2 | 36.8 | 72.6 | 37.8 | 71.8 | 47.5 | 70.4 | 72.3 | 69.3 |
| 552° C.+ | 2.8 | 97.2 | 1.8 | 95.6 | 5.0 | 92.7 | 18.5 | 95.0 | 11.3 | 89.4 | 34.8 | 91.1 |

The data summarized in Tables 1 and 2 herein clearly indicate that the present invention teaches a selective process whereby Fischer-Tropsch waxes can be purified while simultaneously adjusting the hardness and the melting point of the purified wax to within desired limits.

The present invention further relates to a wax as described herein. In particular the invention relates to a treated Fischer-Tropsch wax having a needle penetration value up to 50% greater than the same untreated Fischer-Tropsch wax such treated wax having a melting point within about 5° C. of the same untreated Fischer-Tropsch wax.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. Details of the process may be varied substantially without departing from the spirit of the invention and the exclusive use of all modifications which come within the scope of the appended claims is reserved.

What is claimed is:

1. A process for forming a hydrocarbon wax product from synthesis gas comprising the steps of a) reacting synthesis gas in the presence of a Fischer-Tropsch catalyst at Fischer-Tropsch reaction conditions and recovering a raw Fischer-Tropsch wax having a first needle penetration value and a first melting point;

b) contacting said raw Fischer-Tropsch wax with hydrogen in a hydroisomerization zone in the presence of a hydroisomerization catalyst under hydroisomerization conditions and hydroisomerizing said wax such that 371° C.+ boiling point conversion to 371° C.− in said hydroisomerization zone is less than 10% thus forming an isomerized Fischer-Tropsch wax having a second needle penetration value and a second melting point.

2. The process of claim 1 wherein said second melting point is from greater than 0 to about 5° C. lower than said first melting point and said second needle penetration value is from greater than 0 to about 50% greater than said first needle penetration value.

3. The process of claim 1 wherein said hydroisomerization catalyst utilized in step (b) comprises a non-noble Group VIII metal in conjunction with a Group VI metal, supported on an acidic support.

4. The process of claim 2 wherein said hydroisomerization catalyst utilized in step (b) comprises a non-noble Group VIII metal in conjunction with a Group VI metal, supported on an acidic support.

5. The process of claim 3 wherein said Group VIII metal of said hydroisomerization catalyst employed in step (b) is cobalt, said Group VI metal is molybdenum and said support is silica-alumina and wherein said Fischer Tropsch catalyst employed in step (a) comprises cobalt, ruthenium or mixtures thereof.

6. The process of claim 4 wherein said Group VIII metal of said hydroisomerization catalyst employed in step (b) is cobalt, said Group VI metal is molybdenum and said support is silica-alumina and wherein said Fischer Tropsch catalyst employed in step (a) comprises cobalt, ruthenium or mixtures thereof.

7. The process of claim 1 wherein said hydroisomerization catalyst contains about 1 to 5 weight percent cobalt and about 10–20% by weight molybdenum.

8. The process of claim 2 wherein said hydroisomerization catalyst contains about 1 to 5 weight percent cobalt and about 10–20% by weight molybdenum.

9. The process of claim 1 wherein said hydroisomerization conditions in step (b) include a temperature of about 204° C. to about 343° C. and a hydrogen pressure of about 700–750 psig.

10. The process of claim 9 wherein said hydroisomerization conditions in step (b) include a temperature of about 286° C. to about 321° C.

11. The process of claim 1 wherein said 371° C.+ boiling point conversion to 371° C.− in said hydroisomerization zone is less than about 5%.

12. The process of claim 2 wherein said 371° C.+ boiling point conversion to 371° C.− in said hydroisomerization zone is less than about 5%.

13. The process of claim 11 wherein said 371° C.+ boiling point conversion to 371° C.− in said hydroisomerization zone is less than about 1%.

14. The process of claim 1, wherein said Fischer-Tropsch step is characterized by non-shifting conditions.

15. The process of claim 1 wherein said Fischer-Tropsch reactor is a slurry bubble column reactor.

* * * * *